United States Patent [19]

Haaheim et al.

[11] Patent Number: 4,948,121

[45] Date of Patent: Aug. 14, 1990

[54] EXERCISE MACHINE

[75] Inventors: Gary R. Haaheim, Chaska; Paul M. Theisen, Shakopee; Karl N. Ketter, Roseville, all of Minn.

[73] Assignee: Fitness Master, Inc., Chanhassen, Minn.

[21] Appl. No.: 318,533

[22] Filed: Mar. 3, 1989

Related U.S. Application Data

[63] Continuation of Ser. No. 245,366, Sep. 16, 1988, abandoned.

[51] Int. Cl.[5] ..... A63B 69/18

[52] U.S. Cl. ..... 272/97; 272/70; 434/253

[58] Field of Search ..... 272/70, 93, 97, DIG. 4

[56] References Cited

U.S. PATENT DOCUMENTS

| | | | |
|---|---|---|---|
| 518,967 | 5/1894 | Poole . | |
| 1,982,843 | 12/1934 | Traver . | |
| 2,772,881 | 1/1954 | Fundom . | |
| 2,921,791 | 5/1957 | Berne . | |
| 3,582,069 | 6/1971 | Flick . | |
| 3,659,842 | 5/1972 | Aijala . | |
| 4,023,795 | 5/1977 | Pauls . | |
| 4,342,452 | 8/1982 | Summa . | |
| 4,402,506 | 9/1983 | Jones . | |
| 4,406,451 | 9/1983 | Gaetano . | |
| 4,434,981 | 3/1984 | Norton . | |
| 4,512,571 | 4/1985 | Hermelin . | |
| 4,529,194 | 7/1985 | Haaheim . | |
| 4,618,139 | 10/1986 | Haaheim . | |
| 4,653,749 | 3/1987 | Rorabaugh | 272/97 |
| 4,679,786 | 7/1987 | Rodgers | 272/70 |
| 4,684,121 | 8/1987 | Nestegard | 272/97 |
| 4,709,918 | 12/1987 | Grinblat | 272/70 |
| 4,743,015 | 5/1988 | Marshall | 272/97 |
| 4,781,372 | 11/1988 | McCormack | 272/97 |

FOREIGN PATENT DOCUMENTS

| | | |
|---|---|---|
| 2007987 | 12/1978 | United Kingdom . |
| 2130900 | 11/1982 | United Kingdom . |

*Primary Examiner*—Stephen R. Crow
*Attorney, Agent, or Firm*—Hugh D. Jaeger

[57] ABSTRACT

An improved adjustable exercise machine for safe, smooth and comfortable aerobic conditioning has a frame assembly, a pair of foot skates with rollers attached to each skate permitting the skates to be movably mounted on the frame assembly and a pair of arm pole mechanisms attached to the frame assembly. The improvement comprises the frame assembly having two elongate parallel rails, suitably of extruded aluminum, each having sidewalls each with an elongate groove therein with recesses within the grooves thereby forming sidewall tracks. The rails each have a bottom with an elongate groove therein having elongate recesses within the groove thereby forming a bottom track. The rollers of each skate are adapted to be securely and movably mounted within the respective sidewall tracks of the rails to secure or fasten the skates to the rails. The skates have an inclined top surface sloping downwardly in a forwardly direction. The arm pole mechanisms are adapted to be adjustably attached to the bottom track of the respective rails to permit transverse adjustment of the arms poles with respect to the rails.

18 Claims, 3 Drawing Sheets

EXERCISE MACHINE

RELATIONSHIP TO OTHER APPLICATIONS

This application is a continuation of U.S. Pat. application Ser. No. 245,366, filed Sept. 16, 1988, now abandoned.

BACKGROUND OF THE INVENTION

The present invention relates to exercise machines, and more particularly to machines for simultaneously exercising both arms and both legs in a natural rhythmic skiing motion.

Certain devices or machines in the prior art provide the ability to exercise with motions similar to the present invention. However, these machines suffer from various disadvantages which are overcome by the present improved exercise machine. Such prior devices are shown in U.S. Pat. No. 4,618,139, which was issued to applicant on Oct. 21, 1986, and U.S. Pat. No. 4,529,194, which was issued to applicant on July 16, 1985.

Other known but more primitive exercise machines that exercise both the arms and legs include those disclosed in U.S. Pat. Nos. 4,512,571, 4,434,981, 4,023,795, and 2,772,881. Prior exercise machines that only exercise the legs are disclosed in U.S. Pat. Nos. 4,402,506, 4,406,451, 4,342,452, 3,659,842, 3,582,069, 1,982,843, and U.K. Patent Application GB No. 2,007,987. Additional exercise machines which apparently only exercise the individual's arms are disclosed in U.S. Pat. Nos. 2,921,791 and 518,967.

All of the identified prior art devices provide a limited degree of safe, smooth and comfortable exercise for the arms and legs, legs alone, or arms alone. However, none of the prior patents disclose exercise machines that readily accommodate the varying height, weight and fitness levels of individual users.

There is a need for a comfortable exercise machine that provides no jarring impact on knees and back while yet permitting independent and adjustable arm and leg movement resistances or exertion levels. It is also desirable that the chance of injury with such an exercise machine either be eliminated or substantially reduced.

SUMMARY OF THE INVENTION

An improved adjustable exercise machine for safe, smooth and comfortable aerobic conditioning having a frame assembly, a pair of foot skates with rollers attached to each skate permitting the skates to be movably mounted on the frame assembly, and a pair of arm pole mechanisms attached to the frame assembly. The improvement comprises the frame assembly having two elongate parallel rails, suitably of extruded aluminum, each having sidewalls each with an elongate groove therein with recesses within the grooves thereby forming sidewall tracks. The rails each have a bottom with an elongate groove therein having elongate recesses within the groove thereby forming a bottom track. The rollers of each skate are adapted to be securely and movably mounted within the respective sidewall tracks of the rails to secure or fasten the skates to the rails. The skates have an inclined top surface sloping downwardly in a forward direction. The arm pole mechanisms are adapted to be adjustably attached to the bottom track of the respective rails to permit transverse and longitudinal adjustment of the arm poles with respect to the rails.

It is a principal object and advantage of the present invention to provide an exercise machine that operates in a safe, smooth and comfortable fashion that is readily adjustable for the various fitness levels of a variety of users including those of various heights and weights.

Another advantage of the present invention is that it readily provides variable leg and arm resistances independently of each other while still being readily adjustable in all respects to accommodate various users and their exercise demands.

Another advantage of the present invention is that the downwardly sloped top surfaces of the skates provide a natural skiing posture which minimizes stress on the knees and back. This coupled with the smooth action of the exercise machine assures that no jarring impact occurs on the user's body.

Another advantage of the present invention is that the cable which connects the skates to each other through a friction clutch assembly may readily have its tension and resistance adjusted as not previously heretofore known.

Another advantage of the present invention is that the skates are securely and movably interlocked with the rails to assure that the skates do not come off the exercise machine during vigorous exercise.

BRIEF DESCRIPTION OF THE DRAWINGS

The foregoing and other objects and advantages of the invention will become apparent from the following specification and claims, and with reference to the drawings in which:

DESCRIPTION OF THE PREFERRED EMBODIMENT

Figure 1:
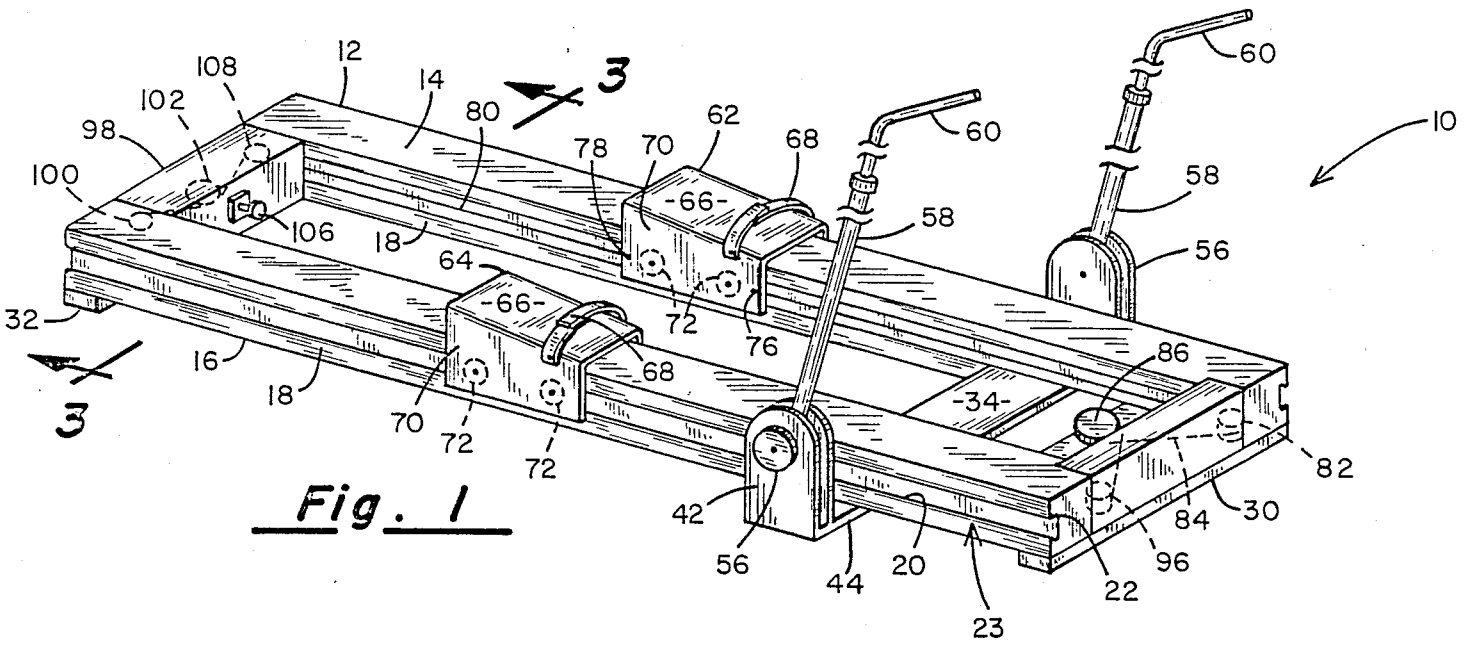
FIG. 1 shows a perspective view of the invention.
Figure 6:
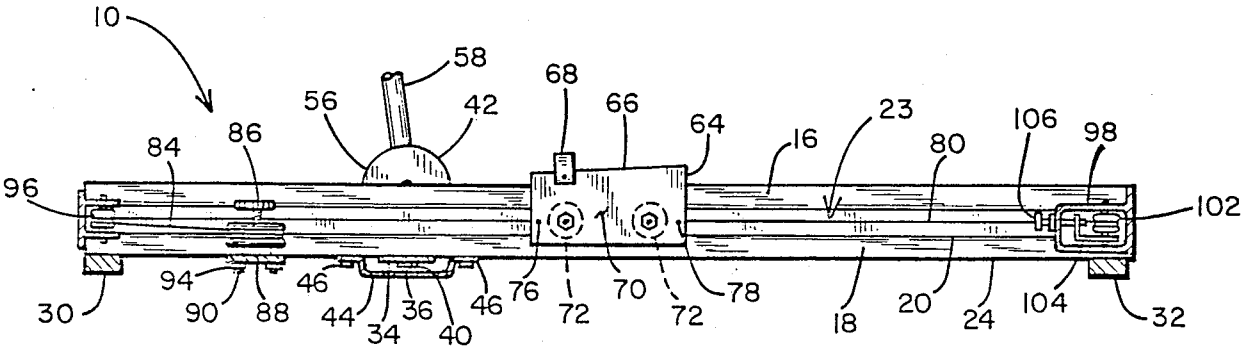
FIG. 6 shows a cross sectional view taken along lines 6—6 of FIG. 2.
Figure 2:
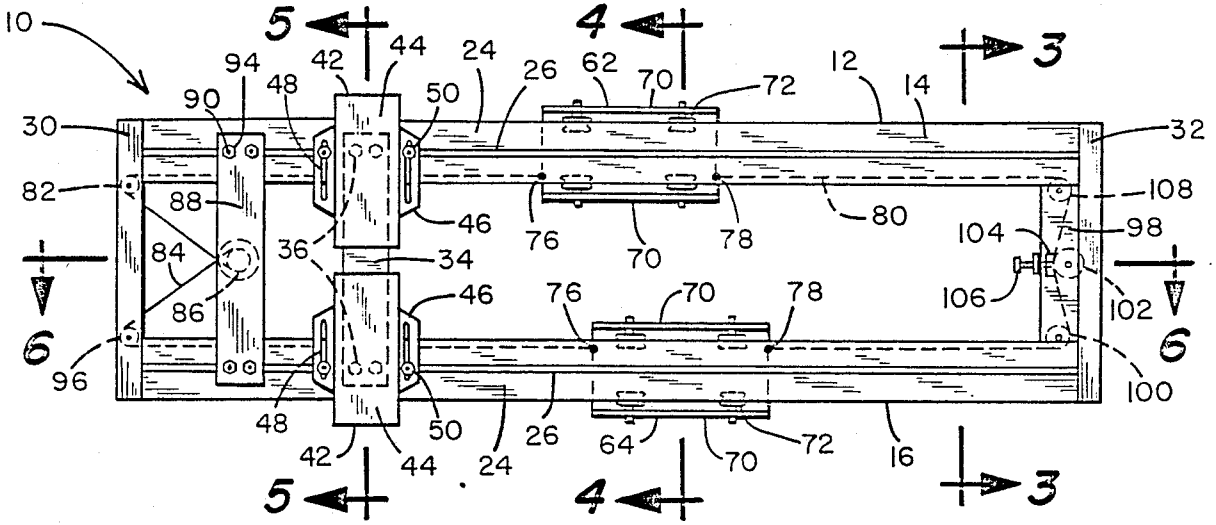
FIG. 2 shows a bottom view of the invention.
Figure 3:
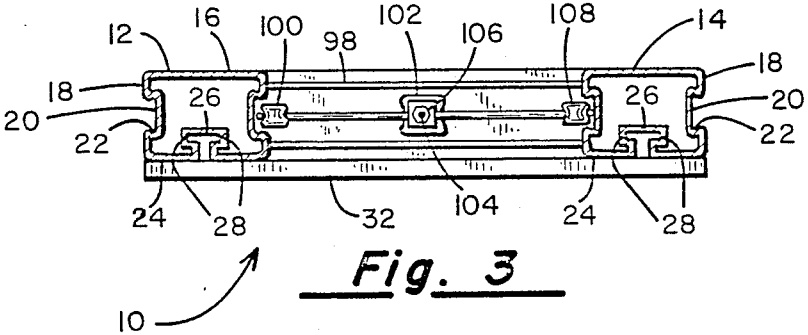
FIG. 3 shows a cross sectional view taken along lines 3—3 of FIGS. 1 and 2.
Figure 7:
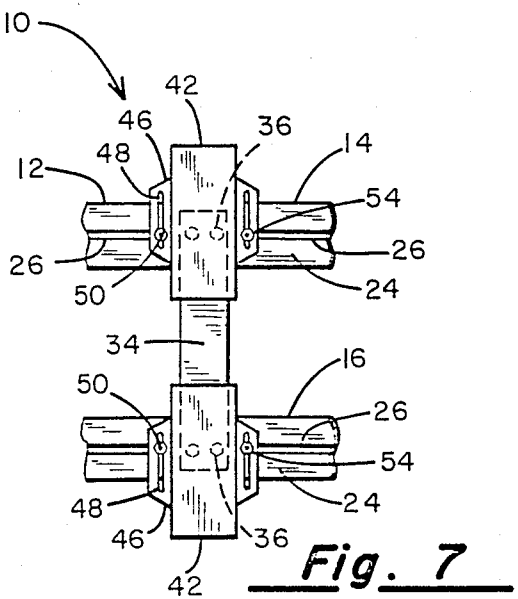
FIG. 7 shows a broken away view of the adjustable arm pole mechanisms transversely extended with respect to the rails.
Figure 4:
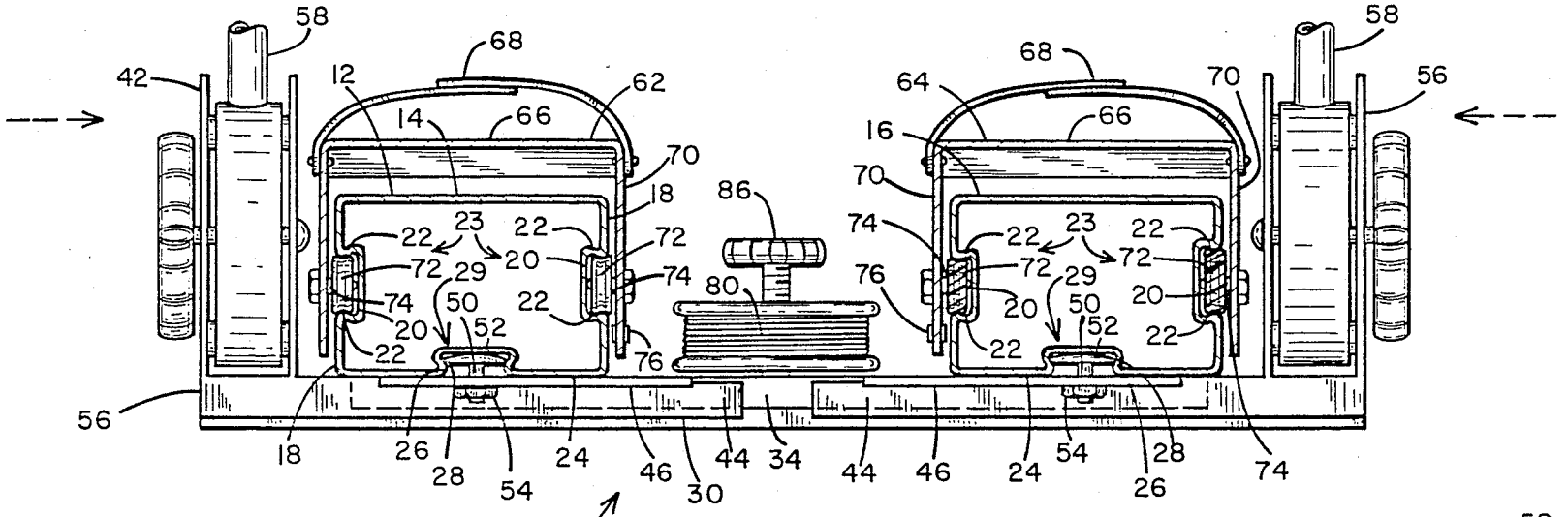
FIG. 4 shows a cross sectional view taken along lines 4—4 of FIG. 2.
Figure 5:
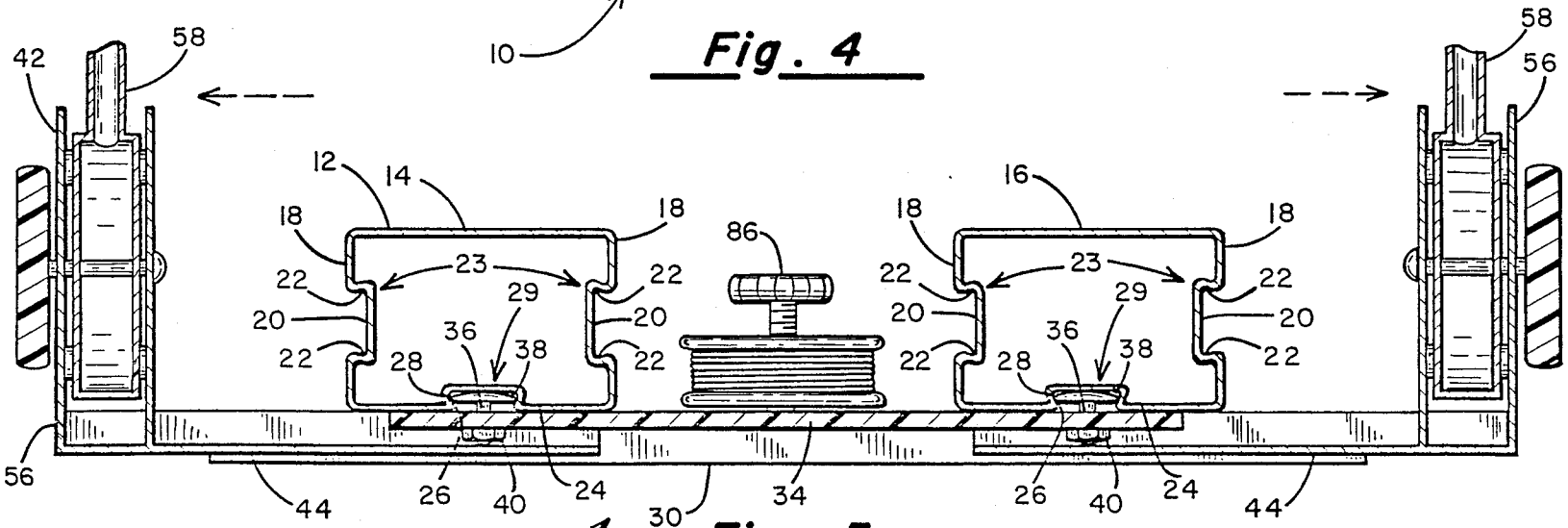
FIG. 5 shows a cross sectional view taken along lines 5—5 of FIG. 2.

Referring to FIGS. 1-7, the improved exercise machine 10 generally includes an elongate frame assembly 12 including left and right rails 14 and 16, transversely and longitudinally adjustable arm pole mechanisms 42, left and right inclined foot skates 62 and 64, movable foot skate friction clutch assembly 86 and cable tension housing 98.

More specifically, elongate frame assembly 12 includes left rail 14 and like right rail 16 both of which are suitably made of elongated extruded aluminum, which preferably is anodized. Rails 14 and 16 each have two sidewalls 18 with elongate grooves 20 therein. Mirror image recesses 22 are in grooves 20 thereby forming the interlocking track or channel 23 which is one of the unique features of the present invention. Rails 14 and 16 also have a bottom 24 with an elongate groove 26 therein similarly having mirror image recesses 28 forming a bottom track or channel 29.

Rails 14 and 16 are interconnected and adapted for resting on a flat floor or surface with front foot 30 and rear foot 32 thereby providing a stable base for exercise machine 10. Somewhat intermediately, tie plate 34 interconnects left and right rails 14 and 16 by action of the heads 38 of threaded bolts 36 slidably interlocked or adjustably attached within grooves 26 (i.e., tracks 29) while bolts 36 pass through tie plate 34 and are held in the desired location by threaded nuts 40.

Arm pole mechanisms 42 are mirror images of each other and are transversely adjustable with respect to elongate rails 14 and 16. Arm pole mechanisms 42 include base plate 44 with side flanges 46 each of which have an elongate slot 48 therein which are transverse with respect to rails 14 and 16. Base plates 44 are adjustably connected to rails 14 and 16 by action of threaded bolts 50, each having an enlarged head 52 which suitably is slidably interlocked or adjustably attached within bottom groove 26 (or track 29) and which pass through slots 48 and are held thereat by threaded nuts 54. To maintain a guided transverse adjustability of arm pole mechanisms 42, base plates 44 are mounted over tie plate 34.

Each arm pole mechanism 42 has an arm pole pivot and friction clutch assembly 56 which is clearly depicted and claimed in applicant's U.S. Pat. No. 4,188,139 and incorporated herein by reference. Arm poles 58 suitably are telescopic with forwardly curved hand grips 60 which will readily permit adaptation of exercise machine 10 for various heights of different users. Hand grips 60 are angled forwardly so that they are comfortably in a vertical position when pivoted to their rearmost operating position.

Left foot skate 62 and right foot skate 64 are like each other and include inclined no-slip top surface 66 with suitable straps 68 for securely holding the user's feet on skates 62 and 64. Each foot skate 62 or 64 has vertical sidewalls 70 for mounting rollers 72 on bearing assemblies 74. Similarly, each skate 62 and 64 has a front cable tie 76 and a rear cable tie 78 located on their respective inner sidewalls 70.

Cable 84 is suitably made of steel and is appropriately connected to front tie 76 of left skate 72 from which cable 84 is wrapped around left front pulley 82. Thereafter, cable 84 forms a cable loop which wraps around foot skate friction clutch assembly 86. Clutch assembly 86 is more clearly depicted and claimed in applicant's U.S. Pat. Nos. 4,529,194 and 4,618,139 and is incorporated herein by reference. Clutch assembly 86 is suitably mounted on tie plate 88 which is mounted to rails 14 and 16 by tie plate 88 having threaded bolts 90 passing therethrough with their respective heads 92 being slidably interlocked or adjustably attached within bottom grooves 26 (or tracks 29) and held thereat by threaded nuts 94. Cable 80 then continues on to right front pulley 96 and to front cable tie 76 of right skate 64. By this arrangement, left and right skates 62 and 64 are appropriately interconnected by cable 84.

A second cable 80 continues on from the rear tie 78 of right skate 64 into cable tension housing 98 and around right rear pulley 100 past tensioning pulley 102. Tensioning pulley 102 is appropriately mounted on carriage 104 within tension housing 98 having tension adjustment bolt 106 connected thereto and extending from housing 98 for easy access. By adjusting bolt 106, carriage 104 supporting tensioning pulley 102 moves inwardly or outwardly appropriately adjusting the tension of cable 80. Cable 80 further extends around left rear pulley 108 to rear tie 78 of left skate 62. By this arrangement, left and right skates 62 and 64 are appropriately interconnected from both their respective front and rear ties 76 and 78 to assure that the user experiences smooth, rhythmic motion with full leg extension during aerobic conditioning on exercise machine 10.

In preparation for operation of exercise machine 10, the user adjusts arm pole mechanisms 42 mounted over tie plate 34 by loosening nuts 54 to properly position base plates 44 to assure that opposing arm pole mechanisms 42 are appropriately spaced depending upon the breadth of the user's shoulders. Next, the cable tensioning pulley 102 may be adjusted by tension adjustment bolt 106 to remove any slack in cable 80. Thereafter, the frictional clutches of arm pole clutch assemblies 56 and foot skate friction clutch assembly 86 may be adjusted for the appropriate exertion level desired by the user.

Next, the user steps on left and right foot skates 62 and 64 and secures his or her feet to the no-slip top surfaces 66 with straps 68. Arm poles 58 are appropriately adjusted to assure a comfortable height for the user. Thereafter, aerobic conditioning may commence similar to a cross-country skiing motion.

The present invention may be embodied in other specific forms without departing from the spirit or essential attributes thereof, and therefore it is desired that the present embodiment be considered in all respects as illustrative and not restrictive, reference being made to the appended claims rather than to the foregoing description to indicate the scope of the invention.

What is claimed:

1. An improved adjustable exercise machine, comprising:

a. a frame assembly having two elongate parallel rails each having at least one sidewall with an elongate groove with an elongate recess therein forming a sidewall track and a bottom with an elongate groove with an elongate recess therein forming a bottom track;

b. a pair of opposing arm pole mechanisms adjustably attached to the bottom track elongate groove to permit transverse and longitudinal adjustment of the mechanisms with respect to the rails; and, c. a pair of foot skates with at least one roller attached to each skate and said at least one roller of each skate securely and moveably mounted in one of the sidewall tracks.

2. The exercise machine of claim 1, wherein the skates have an inclined top surface sloping downwardly in a forward direction.

3. The exercise machine of claim 1, wherein said rails are made of extruded aluminum.

4. The exercise machine of claim 1, further comprising a plurality of pulleys attached to the frame assembly, a cable attached to each skate guided by the pulleys and a skate friction clutch assembly for receiving the cable and adjustably being attached to the bottom tracks of the respective rails.

5. The exercise machine of claim 1, further comprising a plurality of pulleys attached to the frame assembly, a cable attached to each skate guided by the pulleys and an adjustable tension pulley connected to the frame which moves the cable to change tension on the cable.

6. The exercise machine claim 1, wherein the rollers are mounted to the skates with a bearing assembly.

7. The exercise machine of claim 1, wherein the skates have foot retaining straps.

8. The exercise machine of claim 1, wherein the rails each have inner and outer sidewalls with an elongate groove with two recesses therein forming two sidewall tracks that run the length of the rails.

9. The exercise machine of claim 8, wherein the foot skates each have four rollers attached thereto and are moveably interlock within the sidewall tracks of the respective rails to safely secure the skates within the tracks and onto the rail.

10. The exercise machine of claim 1, wherein the bottom grooves each have two recesses therein forming the bottom track that runs the length of the rails, and the arm pole mechanisms each have a base plate adjustably interconnected with the bottom track to permit transverse adjustment of the base plate with respect to the rails.

11. An improved adjustable exercise machine for safe, smooth and comfortable aerobic conditioning having a frame assembly, a plurality of foot skates with a plurality of rollers attached to each skate moveably mounted on the frame assembly, a plurality of arm pole mechanisms attached to the frame assembly wherein the improvement comprises:

a. the frame assembly having two elongate parallel rails each having one sidewall with an elongate groove with a recess therein forming a sidewall track and a bottom with an elongate groove with an elongate recess forming a bottom track;
b. the rollers of each skate securely and moveably mounted in one of the sidewall tracks; and,
c. the arm pole mechanisms adjustably attached to the bottom track to permit transverse adjustment of the mechanisms with respect to the rails.

12. The exercise machine of claim 11, wherein the skates have an inclined top surface sloping downwardly in a forward direction.

13. The exercise machine of claim 11, wherein the rails are made of extruded aluminum.

14. The exercise machine of claim 11, further comprising a plurality of pulleys attached to the frame assembly, a cable attached to each skate guided by the pulleys and an adjustable tension pulley connected to the frame which moves the cable to change tension on the cable.

15. The exercise machine of claim 11, wherein the rails each have inner and outer sidewalls each with an elongate groove with recesses therein forming sidewall tracks that run the length of the rails.

16. The exercise machine of claim 15, wherein the foot skates each have rollers attached thereto which moveably interlock within the tracks of the respective rail to safely secure the skates within the tracks and onto the rail.

17. The exercise machine of claim 11, wherein the bottom grooves each have two recesses therein forming the bottom track that runs the length of the rails, the arm pole mechanisms each having a base plate adjustably interconnected with the bottom track to permit transverse adjustment of the base plate with respect to the rails.

18. An improved adjustable exercise machine for safe, smooth and comfortable aerobic conditioning having a frame assembly, a pair of foot skates with rollers attached to each skate moveably mounted on the frame assembly, a pair of arm pole mechanisms attached to the frame assembly wherein the improvement comprises:

a. the frame assembly having two elongate parallel rails each having one sidewall with an elongate groove with an elongate recess therein forming a sidewall track and a bottom with an elongate groove with an elongate recess therein forming a bottom track;
b. the rollers of each skate securely and moveably mounted in one of the sidewall tracks;
c. the skates having an inclined top surface sloping downwardly in a forward direction; and,
d. the arm pole mechanisms adjustably attached to the bottom track to permit transverse adjustment of the mechanisms with respect to the rails.

* * * * *